United States Patent [19]

Lovik

[11] Patent Number: 4,848,773

[45] Date of Patent: Jul. 18, 1989

[54] BALLOON GAME AND METHOD OF PLAYING SAME

[76] Inventor: Craig J. Lovik, 8565 Custer School Rd., Custer, Wash. 98240

[21] Appl. No.: 161,985

[22] Filed: Feb. 29, 1988

[51] Int. Cl.[4] ..... A63B 67/00

[52] U.S. Cl. ..... 273/318; 273/1 R; 273/1.5 R; 273/85 R; 273/94

[58] Field of Search ..... 273/318, 1 R, 94 L, 273/85 R, 109, 1.5 R; 446/220, 221

[56] References Cited

U.S. PATENT DOCUMENTS

| | | | |
|---|---|---|---|
| 1,229,794 | 6/1917 | Salzer | 446/220 |
| 1,471,886 | 10/1923 | Dessau | 446/220 |
| 2,625,770 | 1/1953 | Steen et al. | 446/221 |
| 2,635,387 | 4/1953 | Anderson | 446/221 |
| 2,927,383 | 3/1960 | Longino | 446/221 |
| 3,623,728 | 11/1971 | Goldfarb | 273/109 |
| 3,870,298 | 3/1975 | Varga | 446/220 |
| 4,136,872 | 1/1979 | Matsumoto | 273/1 L X |
| 4,232,477 | 11/1980 | Lin | 446/220 |
| 4,335,538 | 6/1982 | Greenberg | 446/220 |
| 4,639,232 | 1/1987 | Wang | 446/220 |

*Primary Examiner*—William H. Grieb

[57] ABSTRACT

A balloon game (20, 55, 64, 72), and methods of playing and assembling the same, employing: (a) a conventional balloon (21); (b) a relatively small, soft projectile such as a simulated basketball (25), a simulated football (62), a simulated clown's nose (71), or other projectile (79) adapted to be retained loosely captive within the balloon (21); and (c), a target such as a basketball hoop (23), football goal posts (61), clown's face (65), or other targets (74, 75, 76, 77) adapted to be inserted into the uninflated balloon (21) and fixedly secured to the inner surface of the sidewall (22) thereof in such a manner that when the balloon (21) is inflated and its constricted neck portion (26) is sealed by tying and/or knotting (28), the particular projectile (25, 62, 71, 79) can be propelled at and/or through selected target (23, 61, 66, 74, 75, 76, 77) by the simple expedient of: (i) grasping the balloon (21) and holding the same in a fixed position in space; (ii) stretching the lower extremity (26) of the balloon (21) so as to elongate the same and retract the projectile (25, 62, 71, 79); (iii) aiming the projectile at a selected one of the targets (23, 61, 66, 74, 75, 76, 77); and (iv), releasing the stretched lower extremity (26) of the balloon (21) so as to cause the balloon to revert to its normal, unstretched, inflated state, thus propelling the retracted projectile (25, 62, 71, 79) towards the selected target (23, 61, 66, 74, 75, 76, 77).

23 Claims, 5 Drawing Sheets

BALLOON GAME AND METHOD OF PLAYING SAME

BACKGROUND OF THE INVENTION

1. Technical Field

The present invention relates generally to balloons; and, more particularly, to games, and methods of playing and assembling the same, employing relatively small, soft: (i) balls—e.g., simulated basketballs, footballs, pinballs, etc.—or similar projectiles and/or other projectable objects; and (ii), targets—e.g., basketball hoops and/or nets, goal posts, a clown's face, pockets having different values, etc.—all of which are adapted to be inserted into, and totally contained within, a conventional uninflated balloon in such a manner that, after inflation of the balloon and sealing thereof in a conventional manner, a child or other player can utilize the game by: (a) grasping the balloon; (b) stretching the lower extremity of the balloon—for example, the sealed inflation aperture and constricted neck portion of the balloon—to retract the ball, or other soft projectile, in much the fashion of a slingshot; (c) aiming the retracted soft projectile at the target(s) fixedly mounted within the balloon's interior; and (d), releasing the stretched lower extremity of the balloon while attempting to direct the projectile at, into and/or through the particular target at which it has been aimed.

In use, the target, projectile and balloon may be separately packaged in discrete kit form, thus requiring insertion of the target(s) and projectile(s) into the balloon prior to inflation by the user or some other individual; or, alternatively, the game may be prepackaged with the projectile(s) and target(s) already inserted within the uninflated balloon so that the user need merely inflate the balloon and seal it to render the game operative. In either case, the balloon will preferably include preprinted matter on the balloon itself which can be used to locate the target, as well as to provide a pictorial background appropriate to the particular game involved—including, for example, a scoreboard permitting the user(s) to keep score by simply reflecting the ongoing score on the balloon's surface with an erasable grease pencil or the like. The pictorial background material may further include one or more of drawings of players, stands, spectators, and/or other objects which are environmental to the particular game.

2. Background Art

There are many occasions when balloons are employed as decorations, party favors and the like—for example, at children's birthday parties. Generally, however, such balloons serve simply to provide a decorative effect; and, they are rarely, if ever, used for their potential entertainment value as a game in which the user(s) can participate. Indeed, from the standpoint of a participant-active game, the only game of which the present inventor is aware where balloons are commonly used is that in which sealed balloons are attached to a backboard and the game participants attempt to burst the balloons by throwing darts at them.

There have, however, been some limited attempts to provide balloons with foreign objects inserted inside for some particular purpose, be it decorative or otherwise. For example, an exemplary patent illustrating such an arrangement is U.S. Pat. No. 1,471,886—Dessau, a patent which issued almost sixty-five (65) years ago. Thus Dessau suggests that a favor in the form of an airplane, or other device, be formed of crepe rubber ". . . which can easily be fashioned into varying shapes and can be temporarily rolled up into a compact form. . . ." so that it can ". . . be passed through the inflation aperture. . . ." of the balloon (Dessau Specification, Lines 27-31). This particular patent does not, however, either disclose or suggest the incorporation of a participant-active game within a balloon which can be played by the holder of the balloon.

Other prior art patents of interest include U.S. Pat. Nos. 2,635,387—Anderson [a toy balloon novelty item employing a special valve configuration enabling inflation of a second balloon inside a first balloon ; 2,625,770—Steen, et al [a self-sealing toy balloon again providing for inflation of a second balloon within a first balloon ; and, 2,927,383—Longino [a balloon world satellite employing a pair of spaced, inflated, concentric, spherical body members and a satellite captive within the space therebetween]. Again, however, such patents do not either disclose or suggest the use of a participant-active game inserted within a conventional balloon.

Another patent of interest is that disclosed in U.S. Pat. No. 3,870,298—Varga, a patent which discloses a balancing toy including a post and an integral ring which captures an elongated balloon. While this is clearly a balloon related toy, no provision or suggestion is made for inserting a participant-active game therein.

Other patents of interest contemplate the employment of specially designed inflatable devices which are not conventional balloons and which are exemplified by U.S. Pat. Nos. 4,232,477—Lin [an inflatable hassock-shaped toy]; 4,335,538—Greenberg [an inflatable overhead crib gym toy]; and, 4,639,232—Wang. [a toy having an envelope enclosing a movable mechanism]. Generally stated, the foregoing patents disclose relatively complicated devices formed of a plurality of pieces of material which are heat sealed together after toys and the like are inserted therein to form an enclosed, sealed, inflatable device. However, while these patents relating to inflatable devices do disclose the insertion of toys and/or other objects into the device, they do not disclose or suggest the insertion of a participant-active game therein.

Yet another patent of incidental interest is U.S. Pat. No. 1,229,794—Salzer which discloses an illuminated toy balloon and lighting effect which is achieved by inserting a flashlight-shaped object through the inflation aperture and partially into an uninflated balloon.

However, none of the foregoing patents, nor any other prior art of which the present inventor is aware, contemplates the use of a balloon as the container for an active game which can be participated in by young and old alike. More specifically, such prior art is utterly foreign to the concept of inserting an object—be it a soft, small basketball, football or clown's nose—within a balloon for projection at one or more targets—e.g., a hoop or net, goal post, clown's face or other receptacle(s) or object(s) mounted within the balloon—by the simple expedient of stretching the lower extremity of the inflated sealed balloon in much the same manner as a slingshot and releasing it in a controlled fashion so as to enable the balloon itself to generate the motive power to project the object within the balloon at, and hopefully into or through, the target(s).

SUMMARY OF THE INVENTION

The present invention provides a novel game employing essentially only three (3) elements—viz., (i) a completely conventional inflatable balloon; (ii) at least one (1) small, soft projectile adapted to be inserted into the interior of the balloon prior to inflation and retained loosely captive therein; and (iii), one or more small, soft targets adapted to be inserted into the balloon's interior prior to inflation and thereafter fixed in place at preselected location(s) on the inner surface of the balloon; thereby enabling the user to inflate the balloon, seal the inflated balloon with the projectile and target contained therein by knotting or otherwise tying off the inflation aperture and constricted neck portion of the balloon, and to then play the game, either alone or with others, by stretching the lower extremity of the balloon so as to retract the projectile, aiming the projectile at the target, and releasing the stretched lower extremity of the balloon so as to propel the object towards, and hopefully either into or through, the target. The invention readily lends itself to such games as balloon basketball, balloon football, balloon pinball, and similar balloon games, as well as to such games of skill wherein the user is, for example, attempting to position a small, soft, round red ball simulating a clown's nose into a pocket or other receptical mounted on the balloon's interior surface in the appropriate location on a drawing of a clown's face appearing on the balloon's wall—i.e., in a region located centrally between the clown's eyes and mouth.

Those skilled in the art will appreciate that the foregoing games are intended to be merely exemplary of innumerable games that can be designed which employ one or more targets adapted to be mounted on the inner surface of a conventional balloon's latex sidewall, a ball or similar projectile(s) being mounted inside the balloon prior to inflation, and wherein, when the balloon is inflated and sealed, the user can take advantage of the natural resiliency of the balloon itself to provide the motive power for propelling the ball(s) or other object(s) towards, into and/or through a preselected target.

In one of its important aspects, it is a principal aim of the invention to provide a simple, inexpensive game which can be entirely contained within a conventional balloon and played by children and adults alike; yet, which is essentially harmless and in no way dangerous to the user other than those dangers inherent in the use of any conventional balloon.

A further important objective of the invention is the provision of various types of game devices which can be inserted into the interior of a conventional balloon, and thus convert the balloon from a purely decorative object to one having a utilitarian function in terms of games which can be participated in by children and adults alike.

Still another objective of the invention is to provide a balloon game of the foregoing type wherein the game target(s) incorporate separate mounting means—e.g., magnets, suction cups or the like—which, although they may have no utility within the balloon itself, enable usage of the game pieces outside the environment of a balloon after bursting and/or deflation thereof.

DESCRIPTION OF THE DRAWINGS

These and other objectives and advantages of the present invention will become more readily apparent upon reading the following Detailed Description and upon reference to the attached drawings, in which.

FIG .1 is a fragmentary isometric view of a balloon basketball game embodying features of the present invention, here particularly illustrating the manner in which a user might typically hold the balloon while attempting to aim a small, soft, simulated basketball upwardly and, thereafter, downwardly through a basketball hoop located within, and secured to, the balloon's inner surface.

Figure 1:
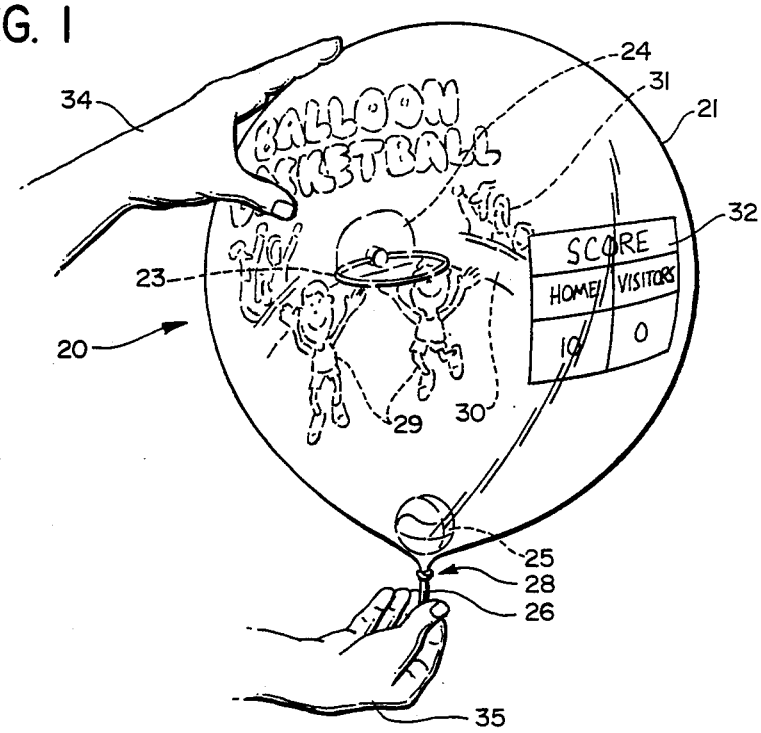

While the present invention is susceptible of various modifications and alternative forms, specific embodiments thereof have been shown by way of example in the drawings and will herein be described in detail. It should be understood, however, that it is not intended to limit the invention to the particular forms disclosed; but, on the contrary, the intention is to cover all modifications, equivalents and/or alternatives falling within the spirit and scope of the invention as expressed in the appended claims.

DETAILED DESCRIPTION

Turning now to the drawings, and directing attention first to FIG. 1, there has been illustrated an exemplary balloon basketball game, generally indicated at 20, here embodying features of the present invention. Thus, as here shown, the exemplary balloon basketball game 20 consists solely of three (3) elements—viz., (i) a completely conventional balloon 21 having a sidewall 22 which is preferably formed of clear, or semi-clear, latex material or the like so as to enable the user to clearly observe the interior of the balloon 21; (ii) a small hoop 23 or basketball net (not shown) which is fixedly attached to the interior sidewall 22 of the balloon on a pictorial presentation of a basketball backboard 24 printed on the balloon; and (iii), a small, soft, simulated basketball 25 which is loosely retained captive within the balloon 21 which has here been shown as inflated and sealed off by knotting the constricted neck portion 26 of the balloon, as generally indicated at 28. Although not essential to the invention, the balloon 21 is preferably preprinted in any desired fashion to pictorially portray such persons and/or objects as are typically present at a basketball game—e.g., one or more players 29, stands 30, spectators 31 and a scoreboard 32. Indeed, the scoreboard 32 can provide a medium upon which a player(s) can insert the score of the ongoing game by physically marking the exterior surface of the balloon 21 with an erasable grease pencil or the like.

In the use of the exemplary basketball 20, the user would merely grasp the inflated balloon in one hand—here, the user's left hand 34—so as to fixedly position the balloon in space while using his/her other hand—here, the user's right hand 35—to pull down on the balloon's lower extremity—for example, the knotted constricted neck portion 26—so as to stretch the balloon 21 and retract the ball 25 in much the fashion of a slingshot. Experience has demonstrated that some skill and dexterity are required—and indeed, are continually developed and improved as the user continues to play the game—to properly aim the ball and to generate the proper amount of loft so as to enable the ball 25 to move upwardly when the constricted neck portion 26 of the balloon is released, and to thereafter pass downwardly through the hoop 23.

Figure 2:
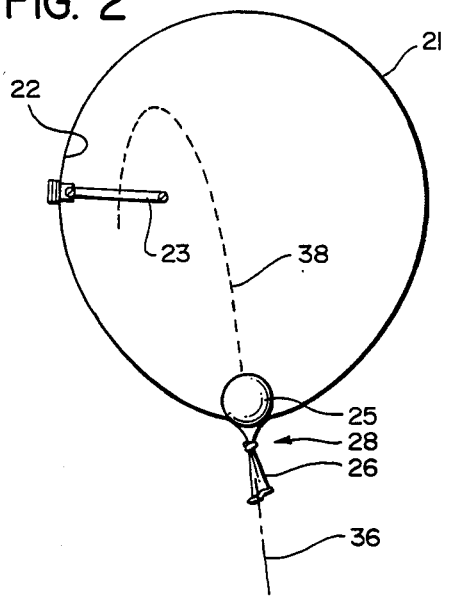
FIG. 2 is a highly diagrammatic elevational view, partially in section, of the balloon basketball game shown in FIG. 1, here depicting the proper manner of aiming the basketball towards the basketball hoop with the desired trajectory of the ball being depicted in broken lines.
Figure 3:
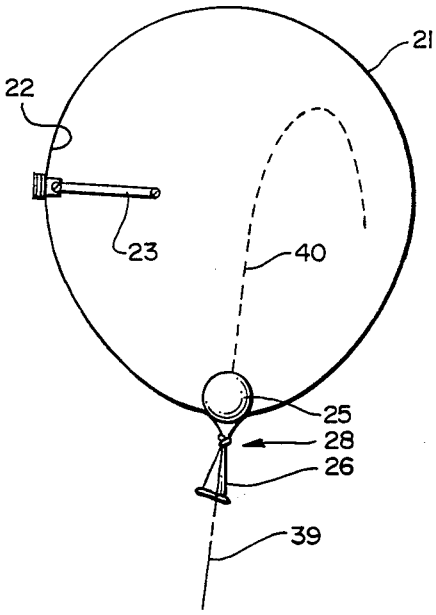
FIG. 3 is a highly diagrammatic elevational view, partially in section, similar to FIG. 2, but here illustrating how an unskilled user might improperly aim the ball with its probable trajectory again being illustrated in broken lines.
Figure 4:
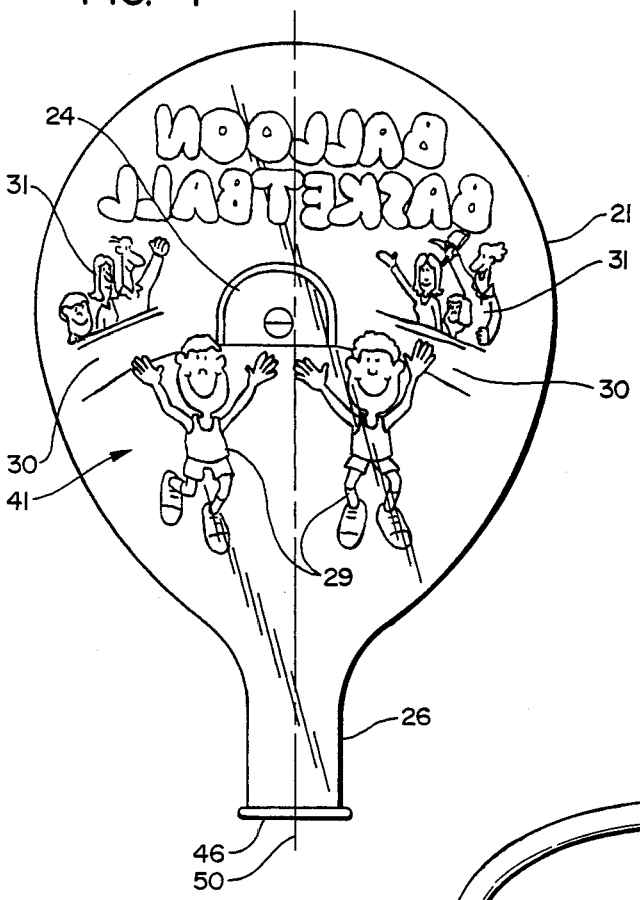
FIG. 4 is an elevational view of an uninflated balloon as viewed from the back of a balloon bearing thereon printed material appropriate for a basketball game—e.g., players, backboards, stands and spectators—prior to insertion and/or mounting of the target hoop and ball within the balloon.

For example, referring to FIG. 2 it will be noted that when the constricted neck portion 26 of the balloon is pulled downwardly along an external axis such as indicated at 36 by the proper amount, the ball 25 will, upon release of the stretched constricted neck portion 26, be projected upwardly solely by motive power resulting from release of the stretched balloon material, hopefully following a trajectory within the balloon's interior, as indicated in broken lines at 38, enabling the basketball 25 to pass downwardly through the hoop 23 and resulting in a score. On the other hand, when the user's skill level is such that he/she does not have the proper aim, the constricted neck portion 26 of the balloon 21 might be pulled downwardly along an external axis 39 which is not directed towards the hoop 23, as best shown in FIG. 3, in which event the ball 25 will tend to move along an improper trajectory directed away from the hoop 23, as indicated in broken lines 40.

It has been found that with more and more experience, the user is able to manipulate the ball 25 so as to cause it to smoothly pass through the hoop 23 without touching either the hoop or the inner surface of the balloon 21 itself; or, by employing the backboard 24 to cause the ball 25 to rebound through the hoop 23—i.e., to cause the ball 25 to act in the same fashion as might be expected in a real live basketball game.

Figure 5:
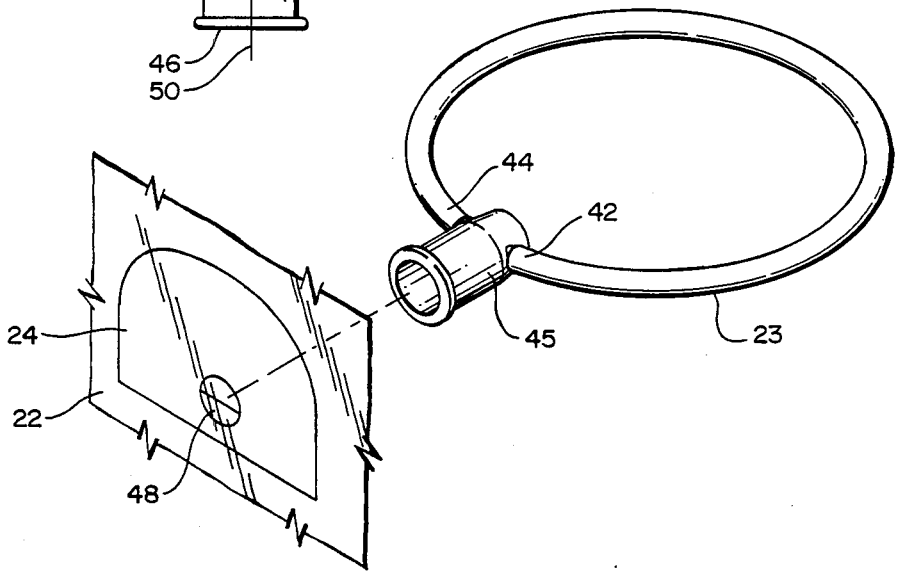
FIG. 5 is a fragmentary, exploded, isometric view here illustrating that portion of the uninflated balloon bearing thereon a pictorial presentation of a basketball backboard (as viewed from outside of the balloon) and the relationship of the hoop which has been manually inserted into the uninflated balloon to permit fixation thereof to the backboard pictorially appearing on the balloon's surface.

Having the foregoing in mind, the manner of assembling the exemplary basketball game 20 will now be described with reference to FIGS. 4–8, conjointly. Thus, referring first to FIGS. 4 and 5, it will be observed that the exemplary conventional balloon 21 has been illustrated in its uninflated state; with the balloon 21 (which has been viewed in FIG. 4 from the rear) having imprinted on its sidewall 22 a pictorial representation of one end of a basketball court, generally indicated at 41. Thus, the pictorial presentation includes a backboard 24, two (2) players 29, stands 30 and spectators 31 (it being understood that the scoreboard 32 shown in FIG. 1 is located on the front of the uninflated balloon 21 which is not visible in FIG. 4). The exemplary basketball hoop 23, best shown in FIG. 5, is preferably formed of a lineal piece of soft, flexible and pliant material—e.g., rubber, plastic or the like—having its opposite ends 42, 44 secured to a small, dowel-like, laterally projecting base 45 which is preferably formed of rigid or semi-rigid plastic and/or rubber material. Thus, the arrangement is such that the soft, flexible pliant material of the hoop 23 readily assumes a hoop-like circular configuration as shown; yet, it can be easily compressed into closely spaced portions essentially lying along the axis of the base 45 so as to permit of ease of insertion of the basketball hoop 23 and base 45 through the inflation aperture 46 and constricted neck portion 26 of the uninflated balloon 21 shown in FIG. 4 and into the interior of the uninflated balloon 21 as shown in FIG. 5.

Figure 6:
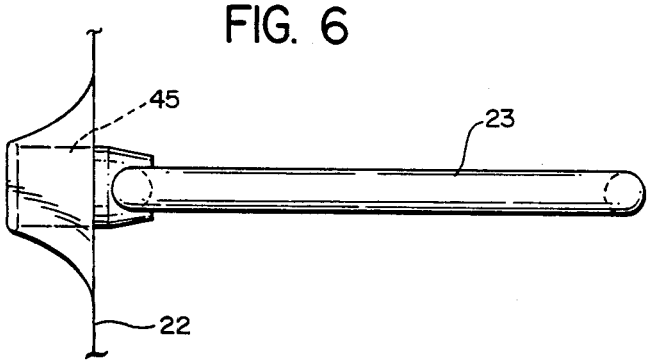
FIG. 6 is a fragmentary side elevational view depicting only a portion of the balloon sidewall, here illustrating how the base of the target hoop is physically pushed into the latex sidewall of the uninflated balloon from the interior thereof so as to displace the latex sidewall of the uninflated balloon and cause it to stretch into conforming relation to, and about, the outer surface of the base of the target hoop.
Figure 7:
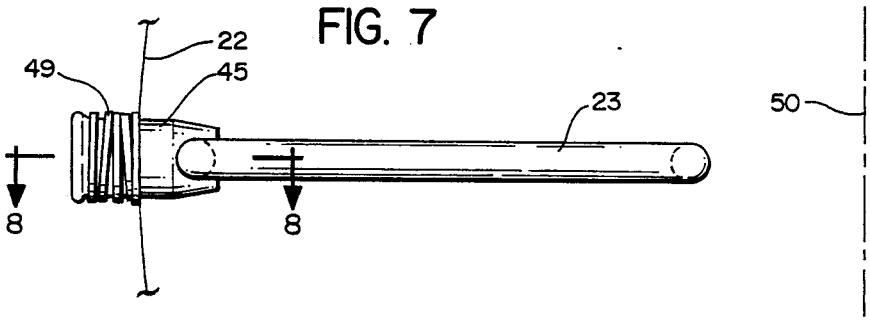
FIG. 7 is a fragmentary side elevational view similar to FIG. 6, but here illustrating one acceptable and effective method for physically attaching the exemplary target hoop to the interior of the balloon's sidewall by, for example, a rubber band wrapped about that portion of the outer surface of the latex sidewall surrounding the target hoop's base.

Once properly positioned in the balloon 21 as shown diagrammatically in FIG. 5, the base 45 of the hoop 23 is manipulated so as to be directed in a direction normal to the backboard 24 imprinted on the balloon's sidewall 22, preferably at a preprinted target area 48 located generally centrally of the backboard 24; and, thereafter, the user physically pushes the base 45 against the sidewall 22 of the uninflated balloon 21 so as to physically displace the latex sidewall 22 of the balloon, as best shown in FIG. 6, causing the latex sidewall material of the uninflated balloon 21 to be stretched about, and in generally conforming relationship to, the outer surface of the base 45. It is then merely necessary to wrap a rubber band 49, or similar constricting tie (not shown), about the outer surface of the thus stretched latex sidewall material of the balloon so as to fixedly secure the hoop 23 to the inner surface of the balloon 21 whereby, when the balloon 21 is inflated as shown in FIG. 1, the hoop's base 45 will project normally from the interior sidewall 22 of the balloon 21, thus deploying the flexible, pliant hoop member 23 in a circular array lying in a plane normal to both the vertical axis 50 (FIGS. 4 and 7) of the balloon and the sidewall 22 of the balloon.

Figure 8:
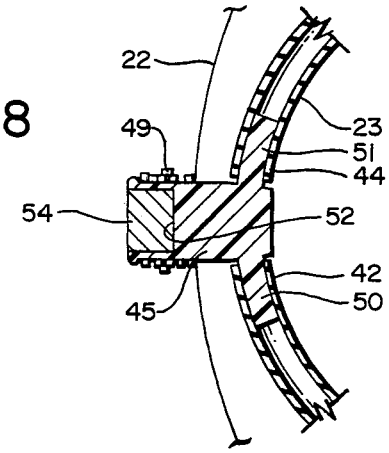
FIG. 8 is a sectional view taken substantially along the line 8—8 in FIG. 7, here illustrating details of an exemplary target hoop construction.

Referring to FIG. 8, it will be observed that the exemplary hoop 23 is here shown as formed of soft, pliable, flexible material that is tubular; while the rigid, or semi-rigid, dowel-like base 45 includes a pair of diametrically opposed, laterally projecting, posts 50, 51 which are somewhat arcuate in configuration, thus enabling the tubular material of the hoop ends 42, 44 to be slid over and frictionally retained on respective different ones of the posts 50, 51. Additionally, if desired, the base 45 of the hoop 23 may include preformed cavity 52 enabling mounting of a magnet 54 or similar device therein so as to enable the hoop 23 to be secured to a metal or other surface—e.g., a refrigerator (not shown)—and, consequently, even should the balloon 21 burst or become deflated, the basketball hoop 23 can be mounted against a fixed vertical planar surface outside the balloon environment so that the user can play with the game pieces simply by attempting to throw the ball simulated basketball 25 (FIGS. 1–3) through the hoop 23.

Of course, those skilled in the art will appreciate from the foregoing description that once the hoop 23 and its base 45 have been properly affixed to the inner surface of the balloon 21 in the manner described above in connection with FIGS. 4–7, it is merely necessary to insert the small, soft, simulated basketball 25 through the inflation aperture 46 and constricted neck portion 26 of the uninflated balloon (FIG. 4), inflate the balloon, and tie off, or otherwise seal, the inflated balloon—for example, by knotting the constricted neck portion 26 as generally indicated at 28 at FIGS. 1–3—thus sealing the balloon 21 in the inflated state shown in FIGS. 1–3 with the target hoop 23 being fixedly mounted therein and the simulated basketball 25, or other projectile, being retained loosely captive therein.

Figure 9:
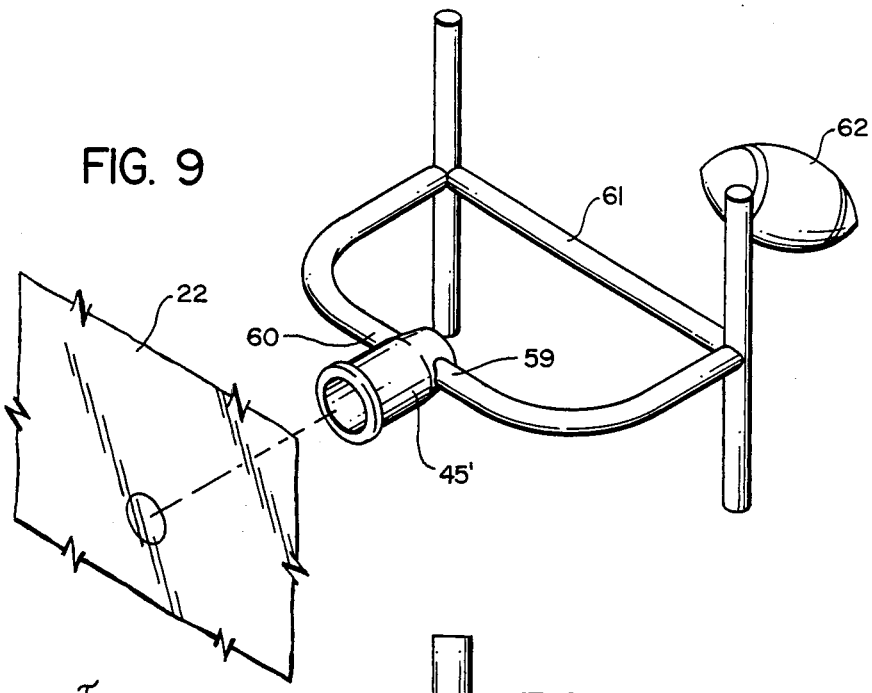
FIG. 9 is a fragmentary, exploded, isometric view similar to FIG. 5, but here illustrating a modified form of the invention in which the target basketball hoop has been replaced by a set of target goal posts, while the small, soft, simulated basketball has been replaced by a small, soft, simulated football.
Figure 10:
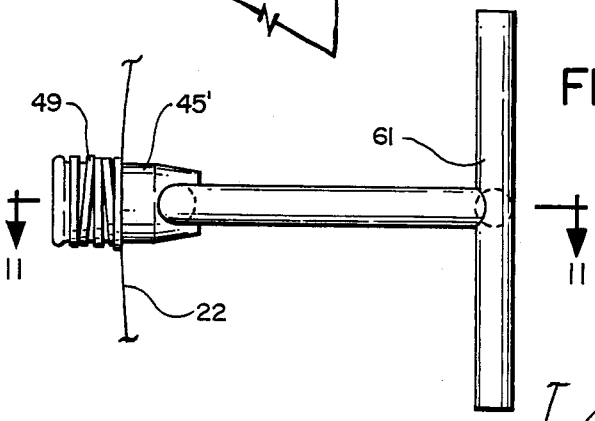
FIG. 10 is a fragmentary side elevational view similar to FIG. 7, but here illustrating the football goal posts of FIG. 1 mounted in place within the balloon's interior.
Figure 11:
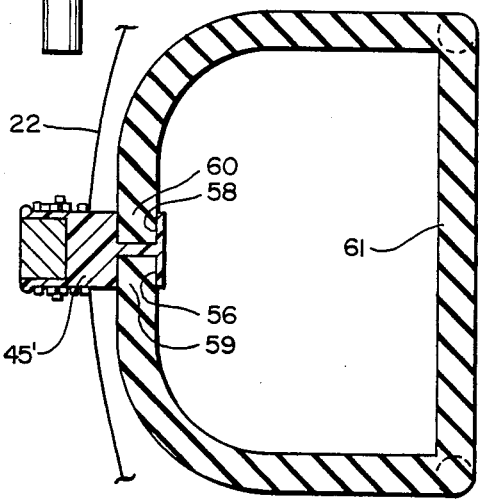
FIG. 11 is a sectional view taken substantially along the line 11—11 in FIG. 10, here illustrating details of the exemplary target goal post construction.

It will also be apparent to those skilled in the art that, while there has hereinabove been described a unique balloon basketball game, the invention in its broadest aspects embraces other types of participant-active balloon games. For example, referring to FIGS. 9–11 conjointly, the invention has been depicted in the form of a balloon football game, generally indicated at 55 in FIG. 9. Thus, as here shown, the base 45' is functionally identical to the base 45 previously described in connection with FIGS. 6–8; except, that in this instance the base 45' is provided with a pair of diametrically opposed, coaxial bores 56, 58 adapted to receive respective different ones of the opposite ends 59, 60 of a soft, flexible, pliant goal post assembly 61 which is preferably formed of solid, rather than tubular, rubber or plastic material. The manner of assembly of the exemplary football game 55 is identical to the exemplary basketball game 20 previously described in connection with FIGS. 4–7; except, that in this instance a small, soft, simulated football 62 (FIG. 9) is inserted into the conventional balloon rather than the small, soft, simulated basketball 25 depicted in FIGS. 1–3. The manner of playing the exemplary football game is, of course, identical to that of playing the basketball game 20 of FIG. 1; except, that the player here attempts to propel the simulated football 62 through the goal post assembly 61 in order to score.

Figure 12:
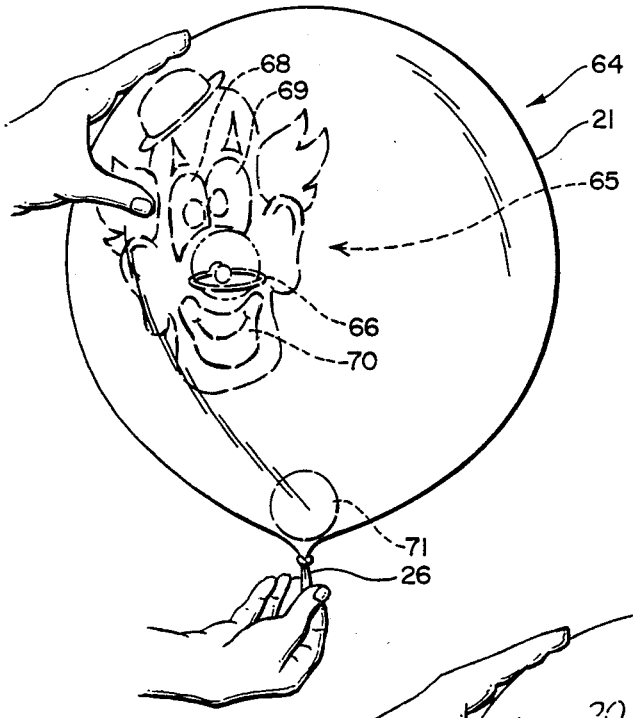
FIG. 12 is a fragmentary isometric view, similar to FIG. 1, but here illustrating a modified form of the invention wherein the balloon has imprinted thereon the face of a clown and a hoop or cup-shaped receptacle is mounted on the balloon's interior sidewall at a location centrally between the clown's eyes and mouth, thus enabling the game user to try to propel a small red ball simulating the clown's nose into the hoop-like, or cup-shaped, receptacle; and, FIG. 13 is a fragmentary isometric view similar to FIGS. 1 and 12, but here illustrating yet another modified form of the invention wherein a multiplicity of hoops having different diameters are mounted at different locations on the interior sidewall of the balloon, with each hoop having a progressively smaller diameter and a corresponding progressively increasing target value, thereby enabling the user to simulate a rudimentary form of pinball game.

Turning next to FIG. 12, yet another balloon game embodying features of the present invention and generally indicated at 64, has been shown. In this form of the invention, the balloon 21 is preprinted with the face of a clown, as generally indicated at 65; but, the clown's face 65, rather than pictorially portraying the typical large, red, bulbous nose of a clown, is devoid of a nose. In place of the clown's nose, the user positions a hoop 66 (which can, for all practical purposes, be identical to the basketball hoop 23 of FIGS. 1–8 or which can take the form of a cup-shaped receptacle (not shown) in the region of the clown's face 65 centrally between the eyes 68, 69 and mouth 70. The manner of mounting the hoop 66, or other receptacle, within the balloon 21 is identical to that for the basketball hoop 23 as previously described in connection with FIGS. 4–8. A small, soft, red ball 71 having a diameter slightly greater than the diameter of the hoop 66 and simulating a clown's bulbous nose is also inserted into the balloon 21 prior to inflation thereof; and, thereafter the balloon is inflated and sealed. The object of the game 64 is to propel the red ball 71 upwardly into the hoop 66, or other receptacle, so as to simulate the clown's nose.

Figure 13:
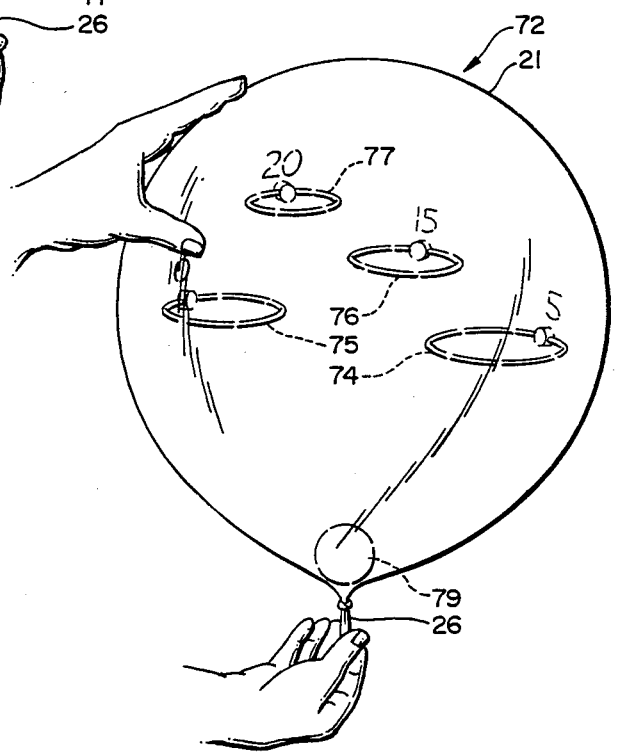

A still further modified balloon game embodying features of the present invention, generally indicated at 72 in FIG. 13, has been illustrated and will hereinbelow be described. Thus, as here shown, four (4) hoops 74, 75, 76 and 77 having progressively smaller diameters and located at progressively increased distances from the constricted neck portion 26 of the balloon 21, are fixedly mounted to the inner surface of the balloon's sidewall 22 at spaced locations in precisely the manner previously described for the basketball hoop 23 of FIGS. 1–8. In this instance, the object of the game is to propel a small ball 79 upwardly over and downwardly through one of the four (4) hoops 74–77, with the score being a function of the user's ability to properly aim the ball 79 so that it passes through a given one of the four (4) hoops 74–77. For example, scoring may be based on the difficulty factor associated with attempting to direct the projectile through a given one of the four (4) hoops 74–77, each of which has a different diameter and is located at a different distance from the constricted neck portion 26 of the balloon 21—e.g., five (5) points may be awarded for manipulating the ball 79 through the largest diameter and closest hoop 74; ten (10) points might be awarded for similarly manipulating the ball 79 through hoop 75; fifteen (15) points might be awarded for manipulating the ball 79 through hoop 76; and, twenty (20) points might be awarded for manipulating the ball 79 through the smallest diameter and most remote hoop 77. In each instance, the game 72 is played by propelling the ball 79 in precisely the same manner as previously described in connection with basketball game 25 shown in FIGS. 1–3—i.e., by stretching the lower extremity—e.g., the constricted neck portion 26—of the balloon 21, aiming the ball 79 at one of the hoops 74–77, and releasing the stretched lower extremity of the balloon 21 so as to propel the ball 79 towards the particular one of the hoops 74–77 at which the user is aiming. In short, the exemplary balloon game 72 depicted in FIG. 13 comprises a rudimentary form of balloon pinball game.

Those skilled in the art will appreciate that there have herein been described various embodiments of new and unique balloon games employing: (i) a conventional balloon; (ii) a target adapted to be fixedly mounted within the balloon; and (iii), a small, soft projectile adapted to be inserted loosely into an uninflated balloon and loosely retained captive therein after inflation and sealing thereof. In each instance the game is played by stretching a portion of the inflated balloon—normally the constricted neck portion of the balloon—so as to retract the projectile in a manner similar to that employed when using a slingshot, aiming the projectile at a given target, and releasing the stretched portion of the balloon. The games are characterized by their simplicity and their low cost; are safe; and, are particularly suitable for use by even small children.

I claim:

1. A balloon game comprising, in combination:

(a) a balloon having: (i) a sidewall formed of stretchable, resilient material; (ii) an inflation aperture; and (iii), a constricted neck portion coupling said inflation aperture to said sidewall;

(b) at least one target positioned within said balloon and fixedly secured to the interior surface of said balloon sidewall, said at least one target defining at least one generally circular receptacle extending perpendicular to said balloon sidewall and adapted to be positioned in a generally horizontal plane within said balloon; and, (c) at least one projectile positioned within said balloon and adapted to be retained loosely captive therein;

whereby, when said balloon is inflated and sealed, a game participant can play the game by: (i) fixing said balloon in space; (ii) grasping a lower extremity of said balloon and stretching it along an axis extending away from said target to elongate said balloon and permit said projectile retained loosely captive therein to be retracted along said axis; (iii) aiming said projectile at a particular one of said target(s); and (iv), releasing said stretched lower extremity of said balloon to propel said projectile along a trajectory aimed towards the particular one of said target(s) at which the participant has aimed said projectile so as to permit the game participant to attempt to seat the projectile in and/or direct the projectile through at least one of said target(s).

2. A balloon game as set forth in claim 1 wherein said at least one target comprises a miniature basketball hoop and said at least one projectile comprises a miniature simulated basketball.

3. A balloon game as set forth in claim 2 wherein said balloon is preprinted to pictorially portray at least one portion of a basketball court.

4. A balloon game as set forth in claim 1 wherein said at least one target comprises a miniature set of football goal posts and said at least one projectile comprises a miniature simulated football.

5. A balloon game as set forth in claim 4 wherein said balloon is preprinted to pictorially portray at least a portion of a football field.

6. A balloon game as set forth in claim 1 wherein said balloon has a clown's face, excluding the clown's nose, preprinted thereon; said at least one target comprises a receptacle projecting into said balloon from the region of said sidewall centrally disposed with respect to the eyes and mouth of said clown's face; and, said projectile comprises a round colored ball which, when projected into said receptacle, simulates the clown's nose.

7. A balloon game as set forth in claim 1 wherein said target(s) comprise a multiplicity of spaced targets having different difficulty factors and score values assigned thereto and wherein the game is played by attempting to maximize the score achieved by successfully projecting said projectile into and/or through those targets having the highest difficulty factors and score values.

8. A balloon game as set forth in claim 1 wherein said target includes means permitting attachment thereof to any desired surface outside the environment of said balloon after bursting and/or deflation thereof so as to enable usage of the target and projectile even outside the environment of said balloon.

9. A prepackaged kit for assembling a balloon game comprising, in combination:

(a) an inflation balloon having: (i) a resilient, stretchable balloon sidewall; (ii) an inflation aperture; and (iii), a constricted neck portion coupling said inflation aperture to said sidewall;

(b) a target adapted to be inserted into the interior of said balloon when in the uninflated state and fixedly secured to the inner surface of said sidewall; and, (c) a projectile adapted to be inserted into the interior of said balloon when in the uninflated state and retained loosely captive therein;

whereby, the user can assemble the game by: (i) inserting said target into said balloon; (ii) affixing said target to the interior surface of said sidewall of said balloon by projecting said target laterally against said sidewall of said balloon so as to displace and stretch said sidewall into conforming surrounding relation with a portion of said target and securing said displaced, stretched, conforming sidewall portion of said balloon to said target portion; (iii) inserting said projectile into the interior of said uninflated balloon; (iv) inflating said balloon; and (v), sealing said balloon in the inflated state by knotting or otherwise tying said constricted neck portion of said balloon so as to create a totally enclosed sealed container defined by said inflated balloon within which said target is fixedly secure and said projectile is retained loosely captive.

10. A prepackaged kit for assembling a balloon game as set forth in claim 9 wherein said target comprises a miniature basketball hoop and said projectile comprises a miniature simulated basketball.

11. A prepackaged kit for assembling a balloon game as set forth in claim 9 wherein said target comprises a miniature set of football goal posts and said projectile comprises a miniature simulated football.

12. A prepackaged kit for assembling a balloon game as set forth in claim 9 wherein said balloon has a clown's face, excluding the clown's nose, preprinted thereon; said target comprises a receptacle projecting into said balloon from the region of said sidewall centrally disposed with respect to the eyes and mouth of said clown's face; and, said projectile comprises a round colored ball which, when projected into said receptacle, simulates the clown's nose.

13. A prepackaged kit for assembling a balloon game as set forth in claim 9 wherein a plurality of said targets are adapted to be mounted at different locations within said balloon with each of said targets being assigned a different score value based on the difficulty factor for directing said projectile through each of said plurality of targets.

14. The method of playing a game with an inflated, sealed, balloon having: (i) at least one target fixed to the interior surface of the balloon extending inwardly therefrom; and (ii), a projectile retained loosely captive therein; said method comprising the steps of:

(a) fixing the inflated balloon in space with the target(s) lying in a generally horizontal plane;

(b) grasping a lower extremity of the balloon and stretching it along an axis extending generally away from the particular target at which the projectile is to be aimed so as to elongate the balloon along that axis and permit the projectile to be retracted along that axis; and, (c) releasing the stretched lower extremity of the balloon so that the natural resiliency of the material from which the balloon is made causes the balloon to return to its normal, unstretched, inflated state, thus projecting the projectile retained loosely captive within the balloon along a trajectory aimed towards a particular target and thus attempting to cause the projectile to impact the target, pass through the target and/or be seated in the target.

15. The method of playing a game as set forth in claim 14 wherein the at least one target comprises a miniature basketball, hoop, the projectile comprises a miniature simulated basketball, and the game is played by attempting to project the basketball through the hoop so as to score a basket.

16. The method of playing a game as set forth in claim 14 wherein the at least one target comprises a set of miniature football goal posts, the projectile comprises a miniature simulated football, and the game is played by attempting to project the football through the goal posts so as to score at least one of an extra point or a field goal.

17. The method of playing a game as set forth in claim 14 wherein the balloon has a clown's face, excluding the clown's nose, printed thereon; the target comprises a receptacle projecting into the balloon from the region of the clown's face centrally located between the clown's eyes an mouth; the projectile comprises a colored ball; and, the game is played by attempting to project the ball into the receptacle to simulate the clown's nose.

18. The method of playing a game as set forth in claim 14 wherein a plurality of targets having different sizes and/or disposed at different distances from the balloon's inflation aperture, and therefore having a preassigned different difficulty factors, are mounted in the balloon; and, the game is played by attempting to maximize the score resulting from projection of the projectile through those targets having different preassigned scores associated therewith.

19. The method of forming an active balloon game that can be participated in by children and adults alike comprising the steps of:

(a) inserting at least one target into the interior of an uninflated balloon by passing the target(s) through the inflation aperture and constricted neck portion of the uninflated balloon and into the interior thereof;

(b) manipulating the target(s) within the uninflated balloon so that a support base on each target is normal to, and in engagement with, the interior sidewall of the uninflated balloon;

(c) pushing the target(s) against the interior sidewall of the uninflated balloon so as to stretch and displace the resilient material of the balloon's sidewall about and in surrounding conforming relation to the support base of each target;

(d) securing the stretched, displaced balloon sidewall material to each target's support base by wrapping tie defining means about the exterior surface of the stretched, displaced balloon sidewall material surrounding each target support base;

(e) inserting at least one projectile into the interior of the uninflated balloon by passing the projectile(s) through the inflation aperture and constricted neck portion of the uninflated balloon into the interior thereof;

(f) inflating the balloon; and, (g) sealing the inflated balloon with the target(s) fixedly secured therein to the balloon sidewall and with the projectile(s) retained loosely captive therein by knotting or otherwise tying off the constricted neck portion of the balloon;

whereby, a player can utilize the game thus produced by grasping a lower extremity of the balloon and stretching the lower extremity along an axis extending away from the particular target at which the player intends to aim a projectile so as to elongate the inflated balloon along that axis and permit the projectile(s) to be retracted along that axis, and by thereafter releasing the stretched lower extremity of the balloon so that the resilient nature of the material from which the balloon is made causes the balloon to revert to its normal unstretched inflated state with the projectile being projected by the balloon along a trajectory aimed towards the particular target at which the player has aimed the projectile.

20. The method of forming an active balloon game as set forth in claim 19 wherein the at least one target comprises a miniature basketball hoop, the projectile comprises a miniature simulated basketball, and the game is played by attempting to project the basketball through the hoop so as to score a basket.

21. The method of forming an active balloon game as set forth in claim 19 wherein the at least one target comprises a set of miniature football goal posts, the projectile comprises a miniature simulated football, and the game is played by attempting to project the football through the goal posts so as to score at least one of an extra point or a field goal.

22. The method of forming an active balloon game as set forth in claim 19 wherein the balloon has a clown's face, excluding the clown's nose, printed thereon: the target comprises a receptacle projecting into the balloon from the region of the clown's face centrally located between the clown's eyes and mouth; the projectile comprises a colored ball; and, the game is played by attempting to project the ball into the receptacle to simulate the clown's nose.

23. The method of forming an active balloon game as set forth in claim 19 wherein a plurality of targets having different sizes and/or disposed at different distances from the balloon's inflation aperture, and therefore having preassigned different difficulty factors, are mounted in the balloon; and, the game is played by attempting to maximize the score resulting from projection of the projectile through those targets having different preassigned scores associated therewith.

* * * * *